US005224308A

United States Patent [19]

Trumbull

[11] Patent Number: 5,224,308

[45] Date of Patent: Jul. 6, 1993

[54] EAVE AND FASCIA

[75] Inventor: Timothy D. Trumbull, Smithfield, Australia

[73] Assignee: Uniframes Holdings Pty Limited, Smithfield, Australia

[21] Appl. No.: 749,911

[22] Filed: Aug. 26, 1991

[30] Foreign Application Priority Data

Aug. 27, 1990 [AU] Australia ..... PK1971

[51] Int. Cl.[5] ..... E04B 7/04

[52] U.S. Cl. ..... 52/94; 52/96; 52/92.1

[58] Field of Search ..... 52/94, 95, 96, 90, 92, 52/93, 639, 643, 644, 650.1, 650.2, 650.3

[56] References Cited

U.S. PATENT DOCUMENTS

| | | | |
|---|---|---|---|
| 1,406,757 | 2/1922 | Pruden . | |
| 3,178,777 | 4/1965 | Nadel et al. . | |
| 3,293,808 | 12/1966 | Duncan . | |
| 3,638,373 | 2/1972 | Chapman | 52/92 |
| 4,455,792 | 6/1984 | Pasco | 52/90 |
| 4,599,830 | 7/1986 | Nawrot | 52/90 |
| 4,878,323 | 11/1989 | Nelson | 52/92 |

*Primary Examiner*—Richard E. Chilcot, Jr.
*Assistant Examiner*—Matthew E. Leno
*Attorney, Agent, or Firm*—Ladas & Parry

[57] ABSTRACT

A roof truss (11) to be installed in a metal building frame (10). The truss (11) includes a bottom chord (12) and a top chord (13) which are to be supported by a stud member (15). The truss (11) is further provided with an eaves and fascia support (18) which has a horizontally extending portion (25) to support eaves sheeting, and a vertical portion (20) to support a fascia member (21).

11 Claims, 7 Drawing Sheets

EAVE AND FASCIA

The present invention relates to building frames and more particularly but not exclusively to metal frames for buildings.

Conventionally, buildings are provided with an eaves structure which includes a fascia member and sheeting providing the eaves. The fixing of the fascia member and eaves sheeting is tedious and time consuming. Still further, metal building frames have not easily provided a fascia and eaves support.

The present application also relates to the invention described in International Application No PCT/AU88/00188 (International Publication No WO88/09854). This particular international application describes a roof truss and beam therefore. The roof truss has a bottom and top cord, with the top cord extending beyond the bottom cord to provide an eaves portion. A bracket is provided at the join of the top cord and bottom cord to secure the two cords together. This bracket also secures the truss frame to the studs or top plate of the wall frame. Additional items are required to provide a fascia and eaves structure. This adds additional cost to the truss frame and associated wall frame and the means of securing the truss frame to the wall frame.

It is the object of the present invention to overcome or substantially ameliorate the above disadvantages.

There is disclosed herein a metal building frame comprising:

a vertical stud member;

a rafter member or upper cord member of a roof truss, supported on the stud member and extending at an acute angle thereto and extending beyond the stud member to provide an eaves portion;

a fascia and eaves support formed of an elongated metal body fixed adjacent an end of said support to said rafter or cord member adjacent the extremity thereof at said eaves portion, and fixed relative to said stud member, said support including a horizontal portion extending from said extremity to adjacent said stud member to support eave sheeting, and a vertical portion at said extremity to support a fascia member.

There is further disclosed herein a roof truss for installation in a building frame, said truss comprising:

a substantially horizontal bottom chord;

at least one top chord fixed to said bottom chord and extending at an acute angle relative thereto, and extending downwardly beyond said bottom chord so as to provide an eaves portion terminating with an extremity;

at least one web member fixed to and extending between the top and bottom chords;

an elongated eaves support member fixed at one end to said extremity and extending generally horizontally therefrom in the direction of extension of said top chord;

an upwardly extending brace fixing the other end of said eaves member to said top and bottom chords to secure said eaves member in position relative thereto; and wherein the extremity and/or said one end of said eaves member providing a vertical portion to which a fascia member can be fixed.

A preferred form of the present invention will now be described by way of example with reference to the accompanying drawings wherein.

Figure 1:
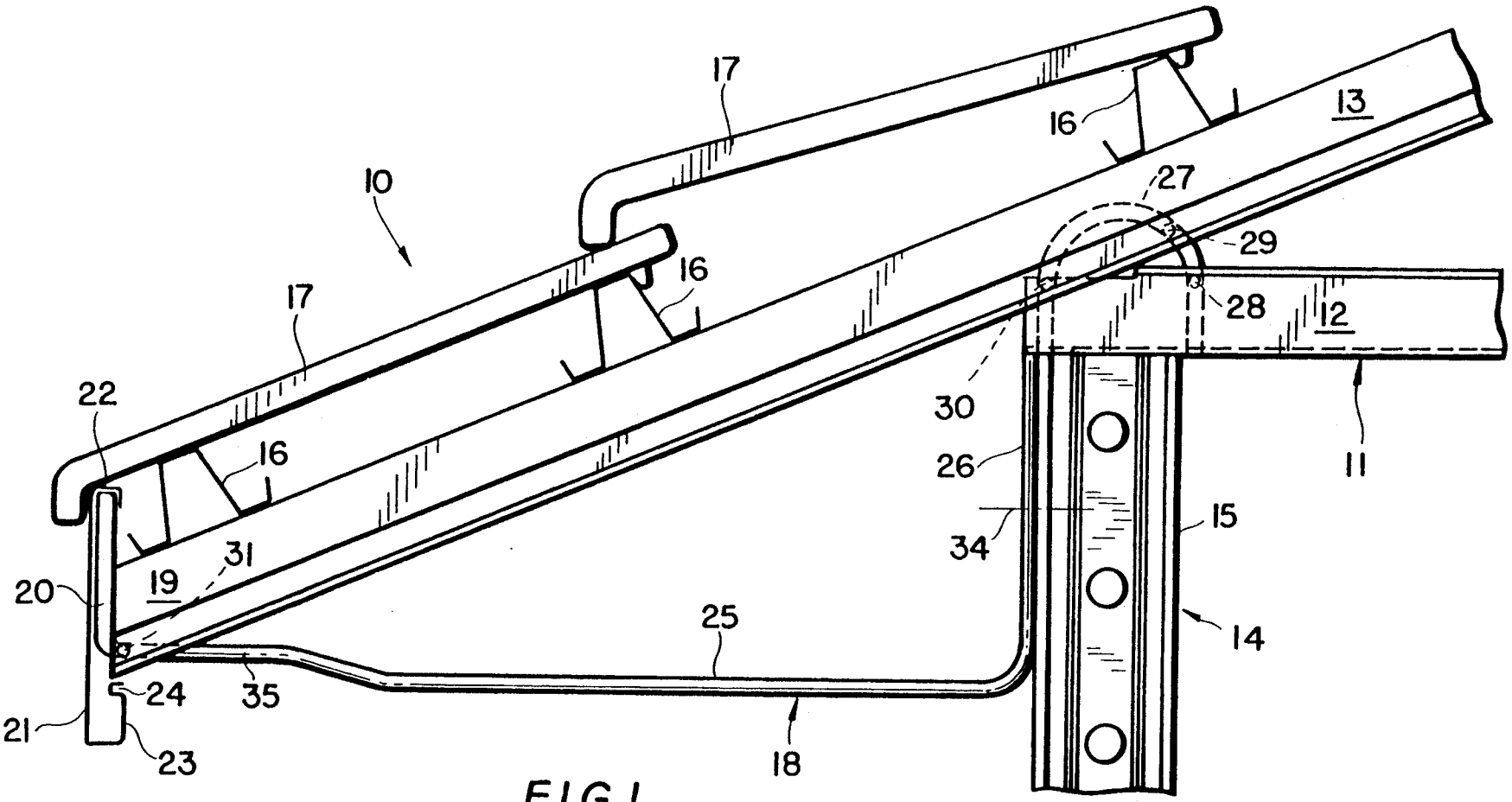
FIG. 1 is a schematic side elevation of a portion of a metal building frame.

In FIGS. 1 to 4 of the accompanying drawings there is schematically depicted a portion 10 of the metal frame of a building. The portion 10 includes a roof truss frame 11 having a bottom cord 12 and a top cord 13. This truss frame 11 could be constructed in accordance with the previously mentioned international application. The truss frame 11 is supported on a wall frame 14 which includes a stud member 15. The wall frame 14 may be constructed in accordance with the invention described in International Application PCT/AU88/00208.

The top cord 13 supports vatten members 16, which in turn support tiles or other roof sheeting 17.

A fascia and eaves support 18, formed of metal tubing or channel, extends from the extremity 19 of the cord 13, to the stud member 15. An end portion 20 of the support 18 is vertically extending so as to support a fascia member 21. The fascia member 21 has an inverted "U-shaped" upper edge 22 which fits over the upper extremity of the portion 20. The lower edge of the fascia member 21 has a flange 23 providing a slot 24 to support an edge of a fascia sheet material. Extending from the portion 20 is a horizontal portion 25 which the eaves sheet material would abut to retain it in a generally horizontal orientation. Still further, the eaves sheet material would be secured to the portion 25 preferably at a location adjacent the stud member 15. The horizontal portion 25 has a raised part 35 adjacent the portion 20 to provide better access to the slot 24.

The support 18 has a further vertical portion 26 which extends to an inverted "U-shaped" pitching bracket 27. The pitching bracket 27 is secured to the bottom cord 12 by means of a fastener applied to the location 28, while the top cord 13 is also secured to the pitching bracket by a threaded fastener applied to the location 29. A further fastener would pass through the bottom cord 12, and the upper cord 13 and the pitching bracket 27 at the location 30. Accordingly, the pitching bracket 27 of the support 18 provides a secure join for the bottom cord 12 and top cord 13 and provides a further securing of the support 18 to the truss frame 11 and therefore the frame 14. The other extremity of the support 18 is secured to the top cord 13 at the location 31, again by a threaded fastener.

Figure 2:
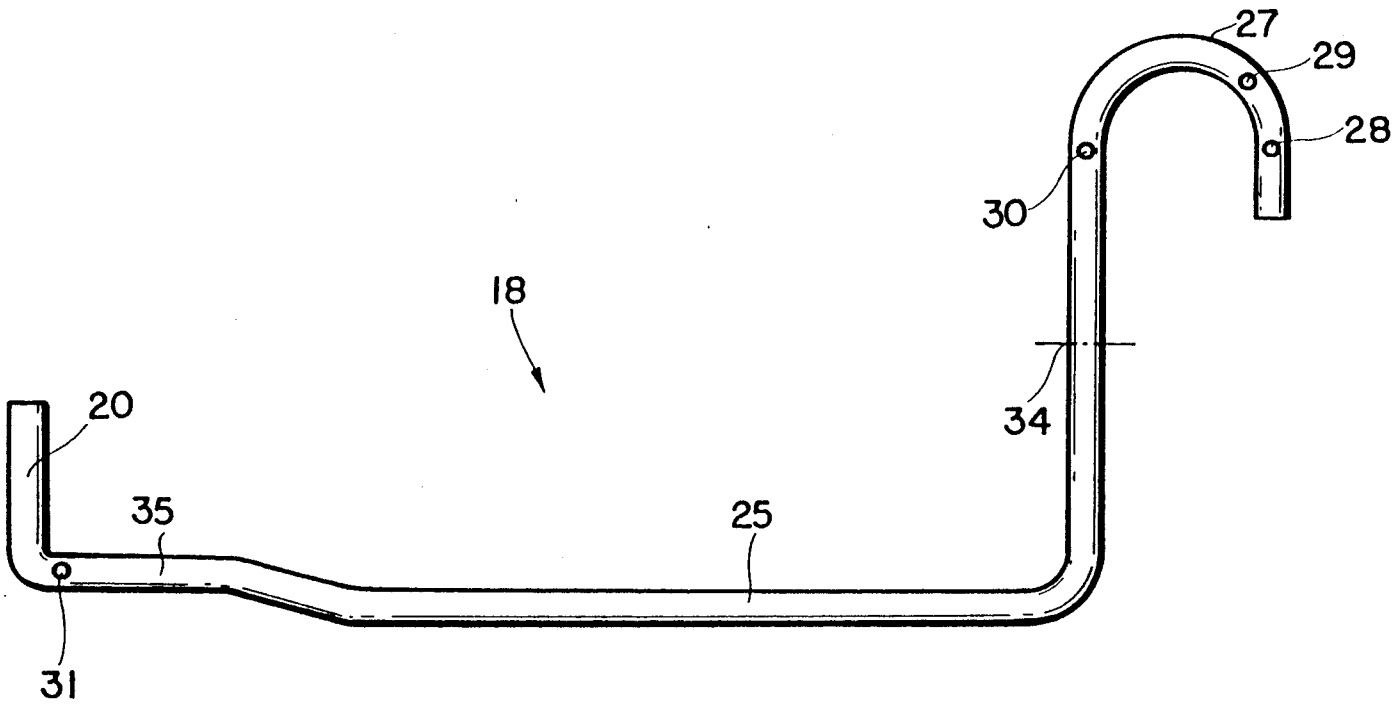
FIG. 2 is a schematic side elevation of a fascia and eave support employed in the frame of FIG. 1.

The support 18 of the above described preferred embodiment is formed of metal tubing or channel bent about several transverse axis to provide the configuration shown in FIG. 2 and employed in FIG. 1.

It should be appreciated that the support 18 could further be secured to the stud member 15 and/or a top plate of the frame 14.

In a frame construction not employing a truss frame, the upper cord 13 would be replaced with a rafter member. In such a configuration, the support 18 would be secured to the rafter member in a similar manner as it is secured to the top cord 13.

Preferably the support is secured to the stud member 15 at the location 34. During assembly of the frame portion 10, the bottom cord 12 and portion 26 form a convenient means to correctly and easily locate the frame 14 relative to the frame 11. This is done by having the cord 12 abut its top plate, and the portion 26 abut the member 15.

Figure 3:
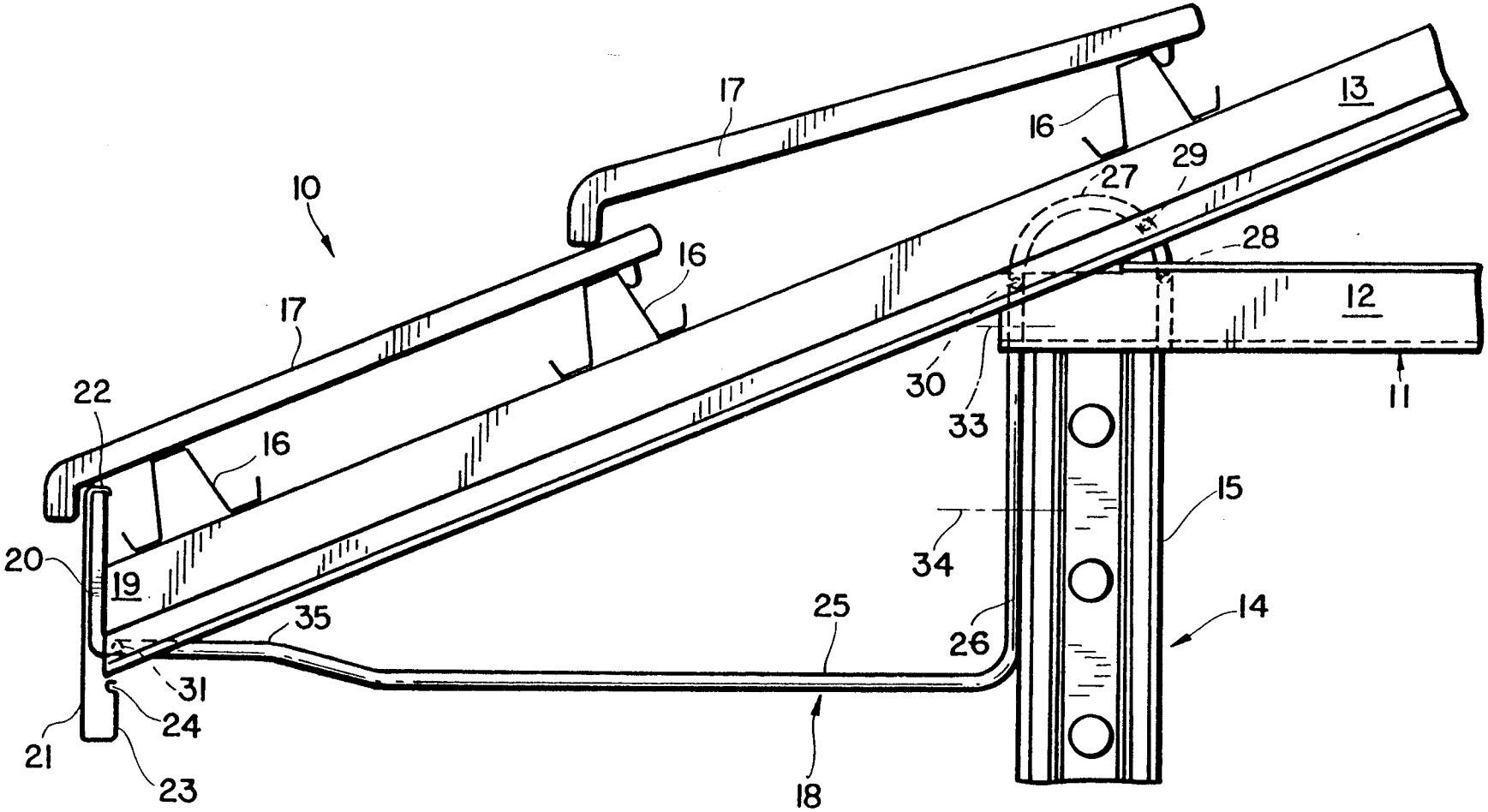
FIG. 3 is a schematic side elevation of a modification of the metal frame of FIG. 1.
Figure 4:
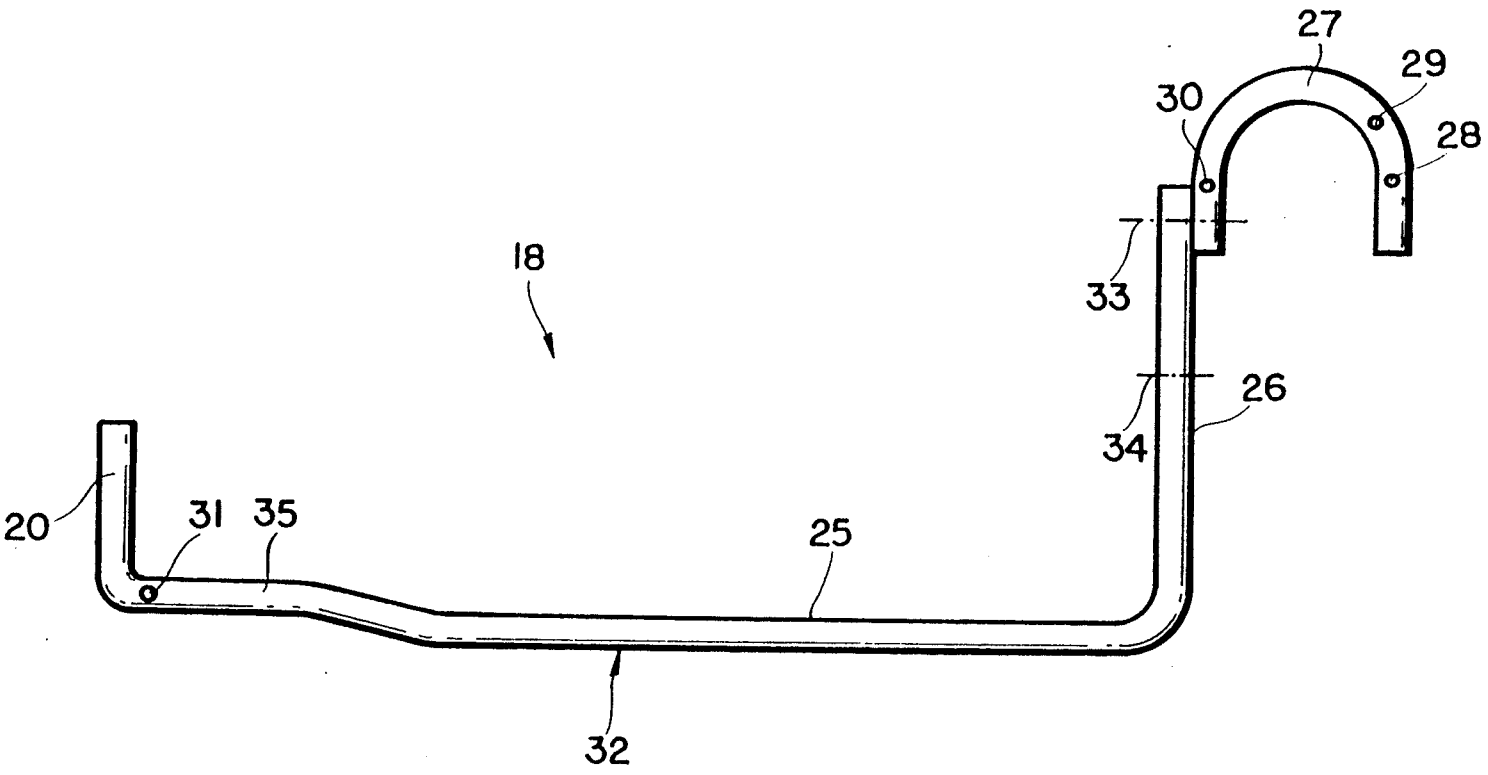
FIG. 4 is a schematic side elevation of the support of FIG. 3.

In FIGS. 3 and 4, the frame portion 10 is again illustrated. In this embodiment, the support 18 consists of an eaves and fascia support portion 32 which is secured to the pitching bracket portion 27 via a threaded fastener at the location 33. Accordingly in this embodiment the support 18 is formed from two distinct portions 27 and 32 as opposed to the embodiment of FIG. 1, where the support 18 is formed from a single length of metal tubing, rod or channel.

Figure 5:
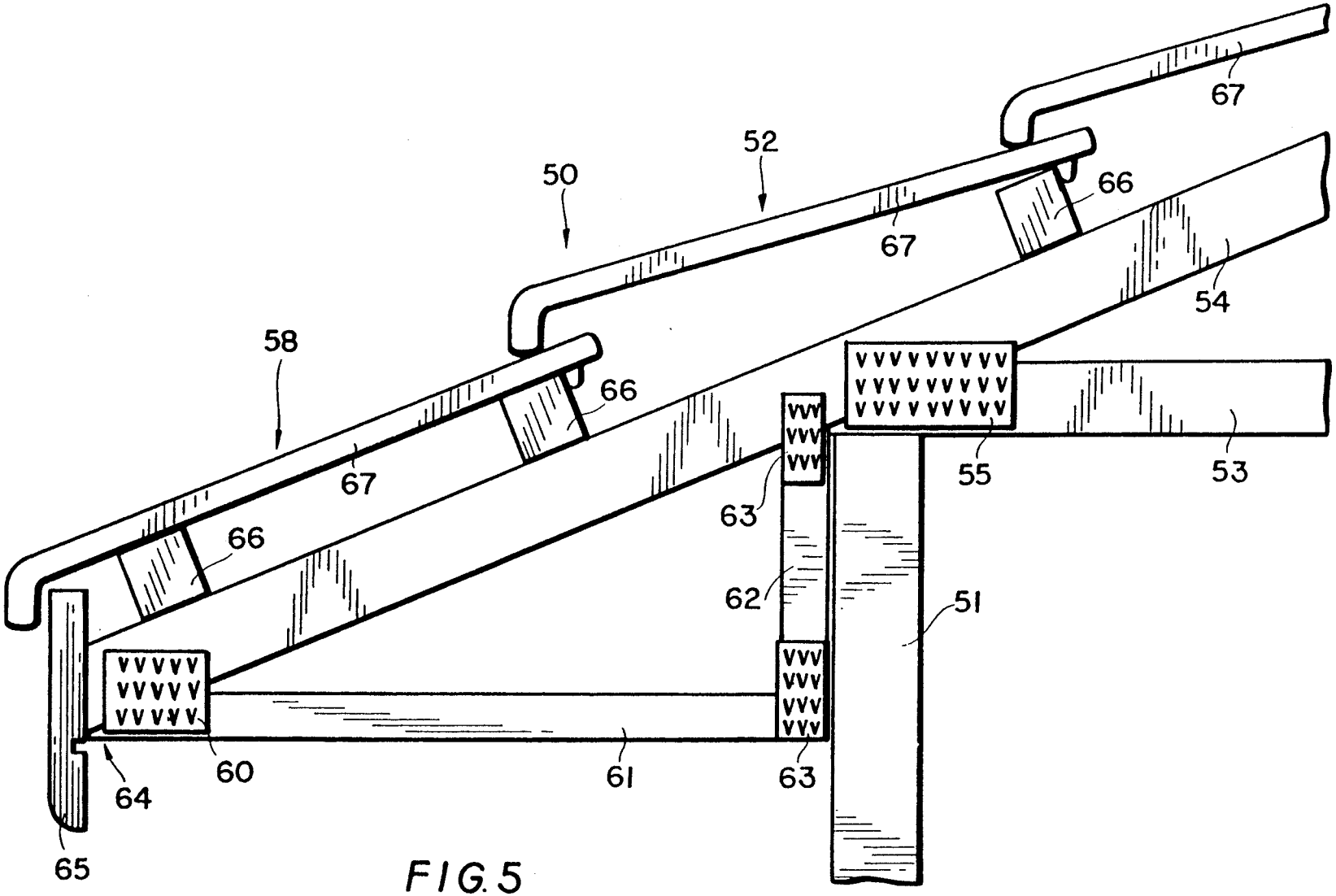
FIG. 5 is a schematic side elevation of the edge portion of a timber building frame.
Figure 6:
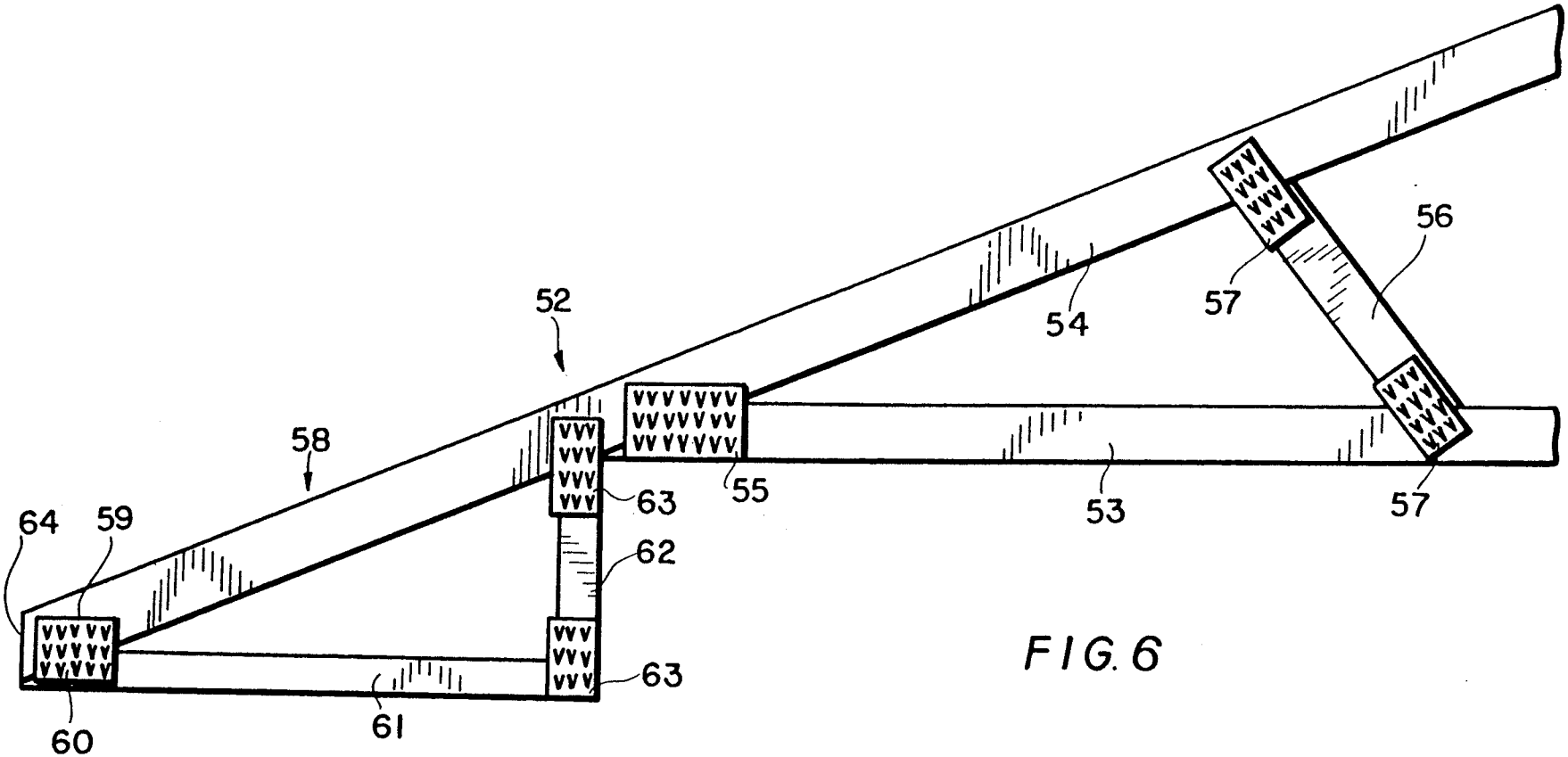
FIG. 6 is a schematic side elevation of a roof truss employed in the frame of FIG. 5.
Figure 7:
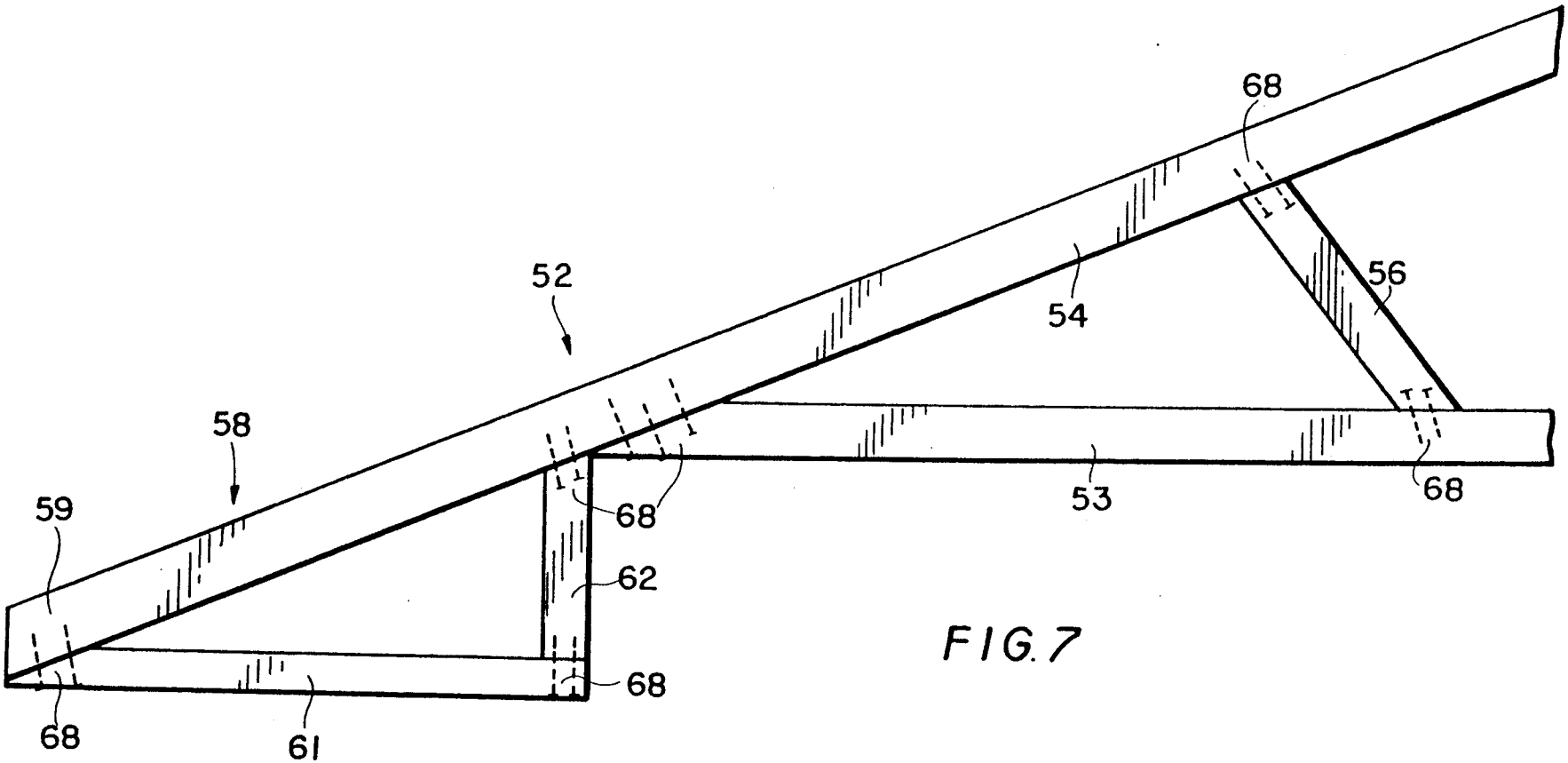
FIG. 7 is a schematic side elevation of an alternative truss to that illustrated in FIG. 6.

In FIGS. 5 to 7, there is schematically depicted a timber frame 50 for a building. The timber frame 50 includes a stud 51 secured to a roof truss 52. The roof truss 52 includes a bottom chord 53 which is generally horizontally oriented, and a top chord 54 secured thereto by a plate fastener 55. Extending between the chords 53 and 54 are web or brace members 56 again by means of plate fasteners 57.

The top chord 54 extends at an acute angle to the bottom chord 53, and extends downwardly therefrom so as to provide an eaves portion 58. The eaves portion 58 has an extremity 59 to which there is fixed again via a plate fastener 60, an eaves support member 61. The member 61 extends substantially horizontally from the extremity 59 and is fixed to the top and/or bottom chords 53 and 54 by means of a support member 62. The support member 62 is secured in position by means of plate fasteners 63. Suitable fasteners may then be used to extend between the truss 52 and stud member 51.

The extremity 59 and/or the eaves member 61 is provided with a vertical end surface 64 to which a fascia board 65 may be secured.

A plurality of the trusses 52 support battens 66 which in turn support tiles 67.

In the embodiment of FIG. 7, the plate fasteners described in FIGS. 5 and 6 are replaced by conventional nails and/or threaded fasteners 68.

The above described preferred embodiment have several advantages relative to a conventional eaves structure. These advantages are as follows:

(1) the support 18 is easily placed in position and initially held due to a good fit between the pitching bracket portion 27 and a top plate over which it passes;

(2) the pitching bracket 27 provides a secure means of fixing the bottom cord 12 to the top cord 13;

(3) the support 18 eliminates the use of soffit rafters which are difficult to install due to the need for them to be accurately oriented horizontally, while the support 18 naturally assumes a position at which the eaves sheeting when secured thereto is positioned so as to be horizontally oriented;

(4) the truss frame 11 can be stored by being stacked on a ground surface or transported again by being stacked on a horizontal low receiving surface of a transport vehicle;

(5) the verticle portion 20 provides an easy means of securing and accurately positioning the fascia member 21;

(6) the support 18 provides a means of securing the extremity 19 in position and inhibiting deformation thereof by torsional stresses;

(7) the support 18 inhibits damage to the extremity 19 of the top cord 13;

(8) the strength of the truss 11 is enhanced making it suitable for use in cyclone areas;

(9) the time required to correctly align and fix the fascia member and eaves sheet material is reduced.

I claim:

1. A preassembled roof truss for installation in a building frame, said truss comprising:

a substantially horizontal bottom chord;

at least one top chord fixed to said bottom chord and extending at an acute angle relative thereto, and extending downwardly beyond said bottom chord so as to provide an eaves portion terminating with an extremity;

at least one web member fixed to and extending between the top and bottom chords;

an elongated eaves support member fixed at one end to said extremity and extending generally horizontally therefrom in the direction of extension of said bottom chord;

an upwardly extending brace fixing the other end of said eaves support member to said top and bottom chords to secure said eaves support member in position relative thereto; and wherein the extremity or said one end of said eaves support member provides a vertical portion to which a fascia member can be fixed.

2. The roof truss of claim 1, wherein said truss is formed of lengths of timber.

3. The truss of claim 1, wherein said eaves support member and brace are integrally formed and are of metal tubing or channel.

4. The truss of claim 3, wherein said eaves support member and brace are provided with a pitching bracket secured to the top and/or bottom chord.

5. The roof truss of claim 3, wherein the eaves support member adjacent said extremity is provided with said vertical portion formed integrally therewith.

6. The preassembled roof truss of claim 3, wherein said eaves support member has a raised part adjacent said extremity.

7. A metal building frame comprising:

a vertical stud member;

a rafter member or upper cord member of a roof truss, supported on the stud member and extending at an acute angle relative and extending beyond the stud member to provide an eaves portion;

a fascia and eaves support formed of an elongated metal body fixed adjacent an end of said support to said rafter or cord member adjacent an extremity thereof at said eaves portion, and fixed relative to said stud member, said support including a horizontal portion extending from said extremity to adjacent said stud member to support eave sheeting, and a vertical portion at said extremity support a fascia member.

8. The building frame of claim 7, wherein the horizontal portion of said fascia and eaves support has a raised part adjacent said vertical portion.

9. The building frame of claim 7, wherein said frame further includes a bottom chord, and said eaves and fascia support includes a pitching bracket extending between and fixed to the top and bottom chords.

10. A preassembled roof truss for installation in a building frame, which building frame includes at least one vertical stud member, said truss comprising:

(a) first support means for supporting a fascia and eaves, said first support means comprising
(i) a substantially horizontal bottom chord, and
(ii) at least one top chord fixed to the bottom chord and extending at an acute angle relative thereto, and extending downwardly beyond said bottom chord so as to provide an eaves portion terminating with an extremity, and (b) second support means cooperating with said first support means for supporting said fascia and eaves, said second support means comprising
(i) sheeting support means for supporting eaves sheeting in a generally horizontal orientation,
(ii) fascia support means at a first end of the second support means comprising a vertical portion for supporting a fascia member, and
(iii) securing means at a second end of the second support means for securing said second support means to said top or bottom chord; said second support means further comprising an upwardly extending brace portion which is adapted to abut against the vertical stud member of the building with the bottom chord supported atop the stud member.

11. A roof truss as claimed in claim 10, wherein the securing means comprises a U-shaped pitching bracket.

* * * * *